United States Patent [19]

Reimuller

[11] 3,945,352

[45] Mar. 23, 1976

[54] FUEL VAPORIZATION AND INJECTION SYSTEM FOR INTERNAL COMBUSTION ENGINE

[75] Inventor: Christian J. Reimuller, Cherry Valley, Calif.

[73] Assignee: Foundation for Research and Engineering Education, Cherry Valley, Calif.

[22] Filed: Oct. 16, 1974

[21] Appl. No.: 515,154

[52] U.S. Cl. ..... 123/34 A; 123/122 E; 123/32 SW

[51] Int. Cl.[2] ..... F02B 69/00; F02M 31/00

[58] Field of Search ..... 123/34 A, 122 E; 222/361

[56] References Cited

UNITED STATES PATENTS

| | | | |
|---|---|---|---|
| 2,653,734 | 9/1953 | Stoker | 222/361 |
| 3,623,639 | 11/1971 | McShirley | 222/361 |
| 3,765,382 | 10/1973 | Vandenberg | 123/34 A |

FOREIGN PATENTS OR APPLICATIONS

| | | | |
|---|---|---|---|
| 26,974 | 11/1911 | United Kingdom | 123/34 A |

*Primary Examiner*—Charles J. Myhre
*Assistant Examiner*—Ronald B. Cox
*Attorney, Agent, or Firm*—Herbert E. Kidder

[57] ABSTRACT

An internal combustion engine having characteristics that lie between the Otto cycle and the Diesel cycle, plus the ability to burn any type of liquid hydrocarbon fuel. Air is compressed to the peak of the compression stage, at which point the high-pressure, high-temperature fuel vapor is injected into the combustion chamber where it mixes with the air and ignites to initiate the power stroke. Liquid hydrocarbon fuel is vaporized in a flash boiler and brought up to high pressure, well in excess of the compression pressure in the combustion chamber, and to temperature above the ignition point. At the peak of compression, a regulable valve opens to allow a metered quantity of the high-pressure vaporized fuel to be injected into the combustion chamber. The vaporized fuel, being already heated well above the ignition temperature, ignites as it mixes with the air in the combustion chamber and burns cleanly and efficiently during the power stroke. Heat of vaporization added to the fuel in the boiler is added to the heat generated by combustion, thereby producing an additional increment of power in the power stroke. During the warm-up stage, the engine operates as a conventional gasoline engine, using a carburetor and spark ignition. When the fuel boiler reaches operating temperature and pressure, the carburetor is switched off, and operation is continued, using high pressure fuel vapor injection.

1 Claim, 8 Drawing Figures

FIG. 1.
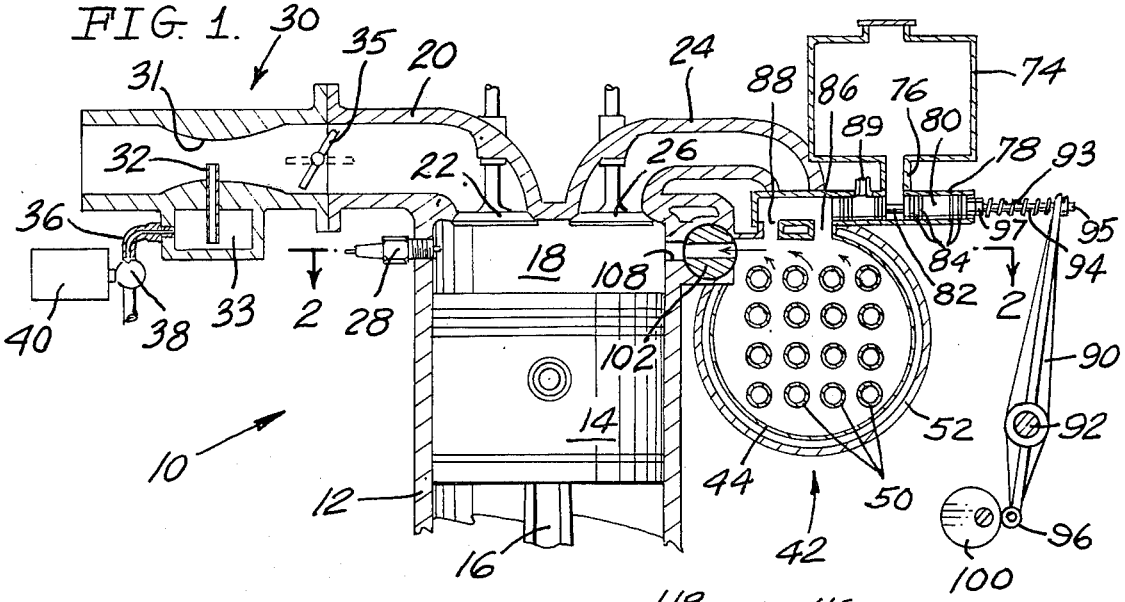
FIG. 2.
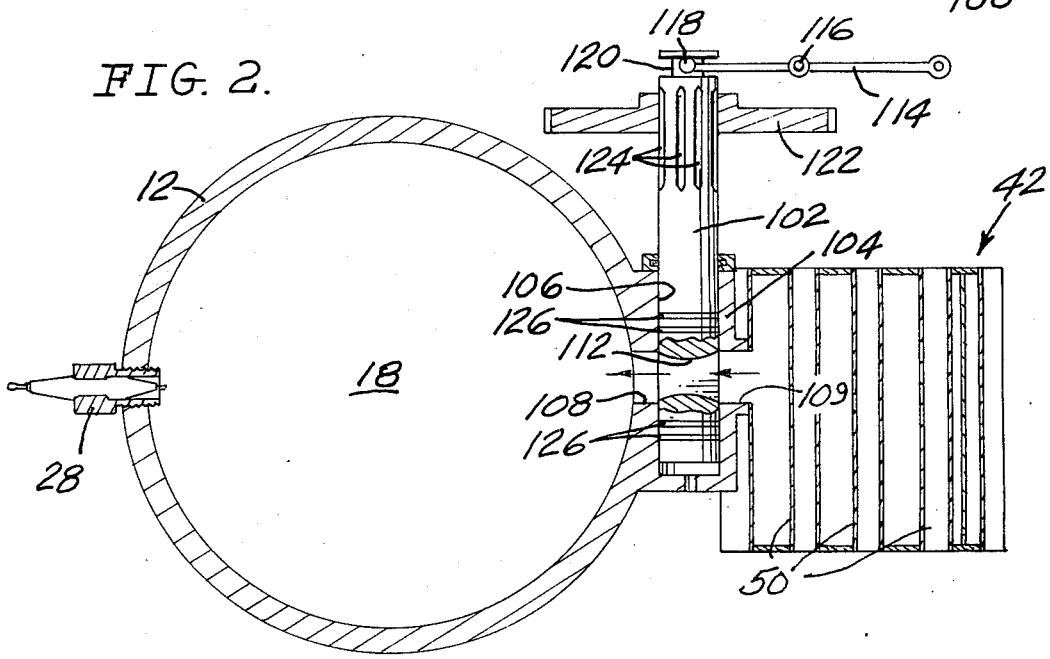
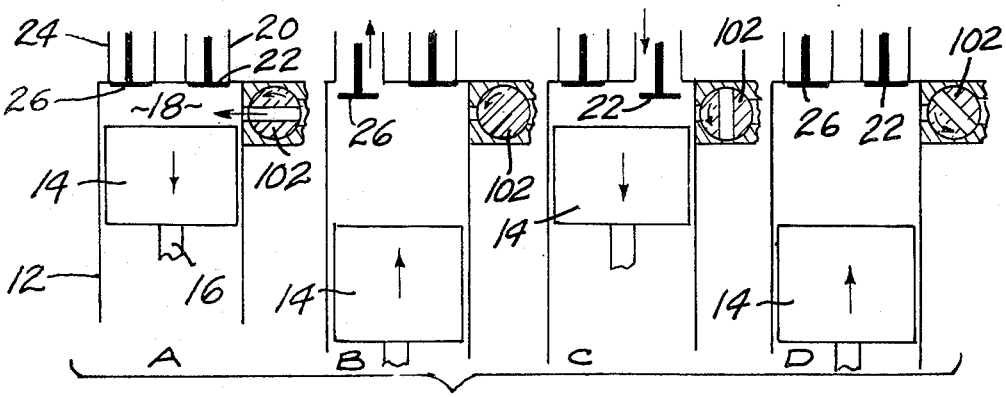
FIG. 3.

FIG. 4.
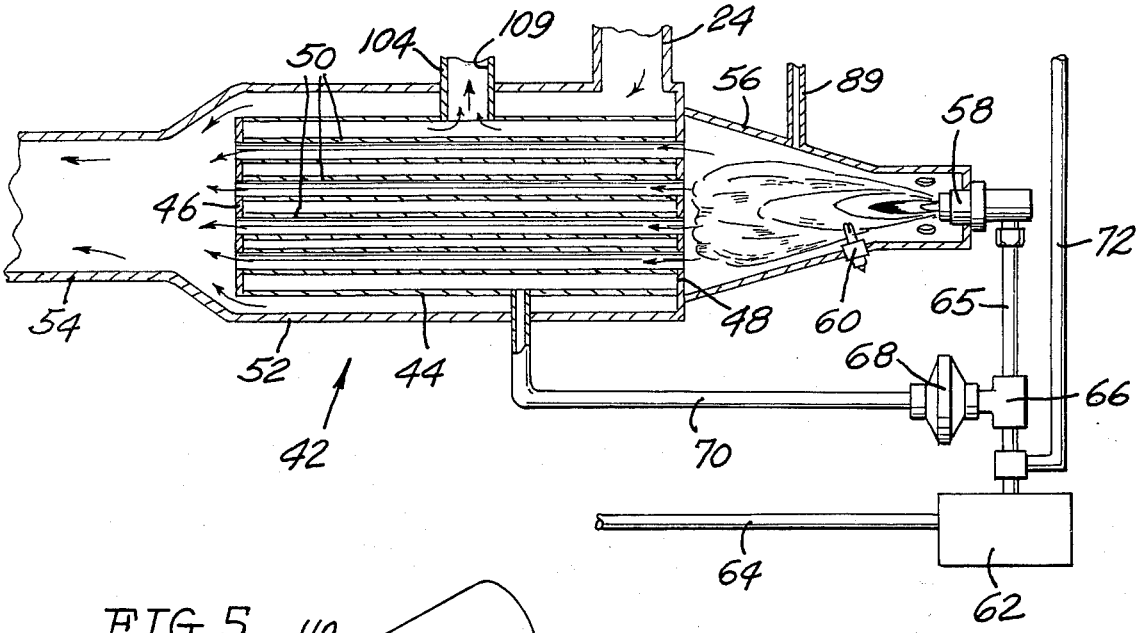
FIG. 5.
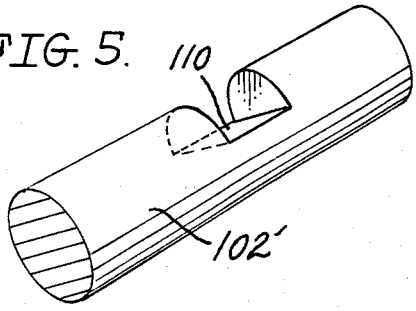
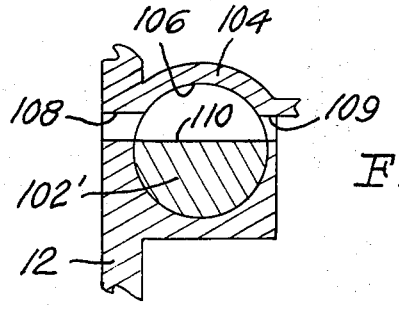
FIG. 6.
FIG. 7.
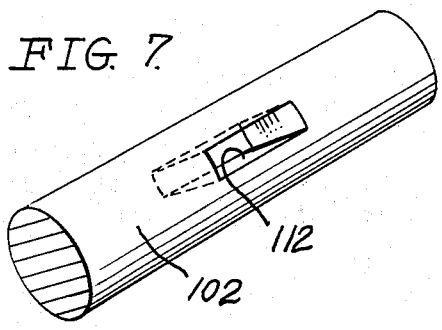
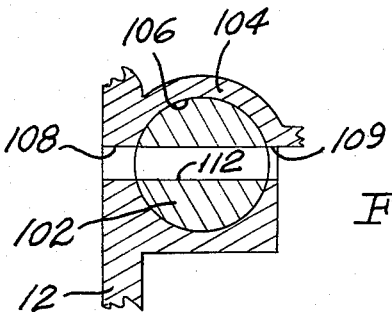
FIG. 8.

FUEL VAPORIZATION AND INJECTION SYSTEM FOR INTERNAL COMBUSTION ENGINE

BACKGROUND OF THE INVENTION

The present invention pertains to internal combustion engines, and more particularly to a new and unique fuel injection system in which liquid hydrocarbon fuel is converted into high-temperature, high-pressure vapor, which is then injected into the combustion chamber at the peak of the compression stage, where it mixes with air and ignites for the power stroke.

Heretofore, virtually all internal combustion engines using liquid hydrocarbon fuel, such as gasoline or diesel oil, have utilized carburetors or fuel injectors to deliver the liquid fuel into the intake air, or into the combustion chamber, in the form of finely atomized mist, which is supposed to evaporate completely, with the result that some of the fuel is still in liquid form during the combustion stage, and because of this it burns incompletely, leaving a considerable amount of unburned fuel in the exhaust to pollute the atmosphere. This unburned fuel in the exhaust also means reduced efficiency, lower power output, and poor fuel consumption characteristics. Moreover, the heat of vaporization which goes into evaporating the fuel in the intake manifold or the combustion chamber is subtracted from the total heat of combustion, with the result that the heat available for expansion on the power stroke is decreased, with a corresponding reduction in power output and efficiency.

In the case of gasoline engines (e.g., Otto cycle), the compression ratio is limited to a maximum value of about 12 to 1, unless exotic fuels of extremely high octane rating are used, as detonation becomes a serious problem.

The only internal combustion engines that burn cleanly, without substantial quantities of unburned fuel in the exhaust are those that have been designed and/or modified to run on natural gas, or on a liquid hydrocarbon fuel (e.g., butane, propane, etc.) which is a gas at atmospheric pressure and is pressurized to make it liquid. While such engines are reasonably satisfactory for use in stationary installations where they can be connected to a municipal gas line or to high-pressure fuel tanks of ample size, they are not suitable for use in automotive vehicles, boats or aircraft. For automobiles, the use of heavy-walled, high-pressure tanks presents design problems, and pressurized fuel tanks are a great hazard in case of an accident. Moreover, the specialized fuel is expensive and not widely available, and the high-pressure tanks must be filled by special fuel transfer apparatus. Furthermore, such gaseous fuels limit the compression ratio of the engine, as they are not high octane fuels.

The diesel engine has some advantages over the gasoline engine. It is more economical of fuel, and it burns the fuel more cleanly, with less unburned hydrocarbon and less carbon monoxide in the exhaust. However, the diesel engine must have compression ratios above 16 to 1 in order to produce sufficient heat of compression to ignite the fuel, and this requires heavy construction, which is expensive.

SUMMARY OF THE INVENTION

The primary object of the present invention is to provide a new and unique type of fuel injection system for internal combustion engines in which liquid hydrocarbon fuel is completely vaporized and superheated in an external fuel "boiler" or retort, and the said vapor is then injected into the combustion chamber at the peak of the compression stage, where it mixes with the compressed air and ignites.

Another object of the invention is to provide a fuel injection system for internal combustion engines, in which the heat of vaporization, plus additional heat, is added to the fuel externally of the combustion chamber, and this heat is added to the total heat generated by combustion of the fuel to provide added power.

Another object of the invention is to provide an internal combustion engine in which the fuel is burned cleanly and efficiently, with no wasteful loss of unburned fuel in the exhaust; less atmospheric pollution; and no loss of power and efficiency due to incomplete combustion.

A further object of the invention is to provide an internal combustion engine that will burn any kind of fuel — gasoline, oil or a mixture of them—and that can operate at compression ratios well above the compression ratio limits that are now considered the maximum for present-day fuels.

Still another object of the invention is to provide an engine of the class described which can be run as a conventional gasoline engine during the warm-up period, while the fuel boiler is coming up to operating pressure, during which time the liquid gasoline fuel is atomized into the intake air by means of a carburetor. When the boiler has reached operating pressure, the fuel supply to the carburetor is shut off, and the engine goes into the fuel injection mode of operation.

These objects are achieved in the present invention by the application of an entirely new principle of fuel vaporization and injection, which combines features of the steam engine (Rankine cycle), gasoline engine (Otto cycle), and oil engine (Diesel cycle), plus an entirely new "heat and pressure increase" stage between the compression and power strokes that in effect, makes this a 5-cycle engine. Liquid fuel is heated in an external "boiler" or pressure retort, until it is completely vaporized and brought up to a pressure of several hundred pounds per square inch, and this superheated fuel vapor is injected through a regulable valve into the combustion chamber at the peak of the compression cycle, where it mixes with the air and ignites. The invention can be applied to any 2-cycle, 4-cycle, gasoline or diesel engine, or rotary engine, such as the Wankel.

The advantages of the invention are as follows: (1) it adds the heat of vaporization and a superheat component to the fuel externally of the combustion chamber and this added heat is recovered in the form of additional power output from the engine (2) it allows the use of higher compression ratios than can be used with conventional gasoline engines using presently available fuels — compression ratios approaching those used in diesel engines—without detonating or "dieseling"; (3) cleaner and more complete combustion of the fuel results in higher efficiency, more power, and cleaner exhaust; (4) all grades of fuel, and mixed fuel can be used; and (5) the engine can be started and run during the warm-up period as a regular gasoline engine, using a carburetor and spark ignition, until the boiler reaches full operating pressure.

In one aspect, the engine of the present invention has some similarity to a diesel engine, as both of them draw fresh air into the cylinder, compress it, and then inject fuel into the compressed air. However, the diesel engine relies upon the heat of the compression to ignite the atomized liquid fuel injected into the combustion chamber by the fuel injectors, whereas in the present invention the fuel is vaporized in the boiler and heated to a temperature far above the flash point, and all that it requires is oxygen to ignite. As a result, injection of the extremely hot fuel vapor into the combustion chamber causes the fuel to ignite the instant that it mixes with the oxygen in the air. Ignition is automatic, regardless of the compression ratio, and no electrical ignition is required except for starting and warm-up. A very important difference between the diesel engine and the present invention is that in the diesel engine, the high compression ratio is necessary to provide the heat that ignites the charge, whereas in the present invention, this heat is added to the fuel vapor in an external retort, or boiler, before it is injected into the combustion chamber, so that all it needs to ignite is oxygen. Thus, the engine of the present invention could be operated at any compression ratio, even as low as 2 to 1, and still perform efficiently, with ignition occurring almost instantaneously upon exposure of the fuel vapor to air.

The fact that the heat of vaporization, plus the superheat, is applied to the fuel in the boiler allows the fuel in vaporized form to carry extra heat into the engine which it acquired externally. This added heat exceeds the flash point of the fuel, and is added to the heat of combustion. Since about half of the heat of the power stroke is lost through the exhaust and cooling system, and heat loss through the cylinder walls is substantially constant, any heat added to the power stroke produces a proportional amount of power increase. In a conventional engine, the heat of vaporization is subtracted from the heat of combustion.

The vaporized fuel injected into the cylinder as the piston approaches the top of its compression stroke produces a sequence of pressure and temperature changes that is novel in the internal combustion art. The pressure changes are as follows: (1) pressure is increased by compression as the piston moves upwardly in the cylinder on the compression stroke; (2) there is an additional increase in pressure within the cylinder as the high-pressure fuel vapor is injected; and (3) combustion produces a large pressure rise in the cylinder as the total pressure due to compression and injection is multiplied by the heat of combustion. At the same time, the temperature changes are as follows: (1) temperature increases by compression on the compressed stroke of the piston; (2) temperature is additionally increased by the injection of superheated fuel vapor into the cylinder; and (3) combustion produces a large increase in temperature. Prior internal combustion engines do not have the pressure and temperature increases in the cylinder due to fuel vapor injection and therefore the present invention is distinctively different from the prior art in this respect.

One of the major advantages of the present invention is that many different kinds and grades of fuels can be used, or a blend or combination of fuels can be used, including materials that are not normally considered fuels. High octane value is not necessary in the fuel, because the full charge of the fuel is not mixed with the air during the compression and ignition stages, as in the conventional engine. Instead, the vaporized fuel is withheld in the present invention until compression is practically completed, and then is injected into the combustion chamber over a substantial period of time while the valve is opening and closing. As the fuel is injected, only that part which has mixed with oxygen is capable of igniting. Thus, ignition takes place progressively over the entire period of fuel injection, and the conditions necessary for detonation are absent in the present invention.

Another advantage of the present invention is that it can be operated with spark ignition if the fuel oil is of a type that its ignition temperature approaches the coking temperature of the oil. In that case, the fuel might be vaporized and brought up to high pressure (e.g., at least 30 psi above the compression pressure) and after discharging the heated fuel vapor into the combustion chamber, ignition is initiated by the spark plug.

One unique feature of the invention is that the compression ratio within the combustion chamber is actually increased by the fuel injection. The increase may be as much as 15 to 20%.

The foregoing and other objects and advantages of the invention will become apparent to those skilled in the art from the following detailed description of the preferred embodiment thereof, with reference to the accompanying drawings.

BRIEF DESCRIPTION OF THE DRAWINGS

FIG. 1 is a schematic sectional view through one cylinder of an engine of the 4-stroke cycle type, embodying the principles of the invention;

FIG. 2 is an enlarged fragmentary sectional view taken at 2—2 in FIG. 1;

FIG. 3 shows schematically the 4 cycles of operation;

FIG. 4 is a fragmentary sectional view through the fuel boiler;

FIG. 5 is a perspective view of one form of transfer valve for allowing the high pressure vapor to be injected into the combustion chamber;

FIG. 6 is a fragmentary sectional view, showing the valve of FIG. 5 in its housing, with the valve in its open position;

FIG. 7 is a perspective view of another form of transfer valve, in which the valve aperture is in the form of a narrow slot; and FIG. 8 is a fragmentary sectional view, showing the valve of FIG. 7 in its housing, the valve being shown in its open position.

DESCRIPTION OF THE PREFERRED EMBODIMENT

In the drawings, the internal combustion engine embodying the invention is designated in its entirety by the reference numeral 10, of which the upper portion only of the cylinder 12, piston 14, and associated parts are shown in FIG. 1. The illustrative engine 10 is a 4-stroke cycle, piston-type gasoline engine, but the invention is not limited to this type of engine, and is equally applicable to a 2-stroke cycle rotary (e.g., Wankel engine), and diesel engines.

Piston 14 slides vertically within the cylinder 12, and is connected by a connecting rod 16 to the crankshaft (not shown). Air (or a mixture of air and carbureted gasoline warm-up) is drawn into the combustion chamber 18 through intake manifold 20, controlled by intake valve 22; while the exhaust gas is discharged through an exhaust manifold 24, controlled by an exhaust valve 26. A conventional sparkplug 28 screwed into the cylinder head and connected to the usual distributor (not shown), ignites the charge when the engine is operating as a conventional gasoline engine during starting and warm-up, as will be described in more detail presently. A carburetor 30 is connected to the intake manifold 20, and has the usual venturi 31, fuel jet 32, float chamber 33, and throttle valve 35. The float chamber 33 is supplied with gasoline by a fuel line 36, having a cut-off valve 38 actuated by a solenoid 40.

The engine described to this point (with the exception of solenoid valve 38, 40) is essentially a conventional 4-stroke cycle gasoline engine, and operates as such during starting and warm-up. After warm-up has been completed, the engine is switched over to a different mode of operation involving fuel vaporization and injection, and it is with this new mode of operation that the present invention is concerned.

Mounted alongside the cylinder 12 is a fuel boiler 42, which may take any form, but is herein shown as a fire-tube flash boiler, comprising a cylindrical boiler shell 44 having end plates 46, 48 and fire tubes 50. Surrounding the boiler shell 44 and spaced radially outward a short distance therefrom is a cylindrical housing 52, one end of which is necked down and joined to an exhaust pipe 54, as shown in FIG. 4. The exhaust manifold 24 from cylinder 12 is connected to the housing 52 near the end opposite the exhaust pipe 54, as shown in FIG. 4, and the hot exhaust gas swirls around the boiler shell 44 on its way toward the exhaust pipe, adding its heat to the boiler as it goes.

Attached to end plate 48 and extending outwardly therefrom coaxially with the cylindrical boiler shell 44 is a generally conical combustion chamber 56 having a burner 58 at the outer end thereof which throws a flame toward the boiler and through the fire-tubes 50. An electrical igniter 60 screwed into the side wall of the combustion chamber 56 serves to ignite the flame of the burner 58 whenever the burner is turned on.

The burner 58 is supplied with fuel by a pump 62, which draws fuel from a supply tank (not shown) through a fuel line 64, and discharges the fuel to the burner 58 through a line 65. A shut-off valve 66 is serially connected into the line 65, and this is actuated by a pressure-regulated actuator 68. Actuator 68 is connected by a pressure line 70 to the interior of boiler 42, and its function is to reduce the supply of fuel to the burner 58 when the pressure in the boiler exceeds a predetermined level, thereby reducing the flame to maintain an even pressure, and also to avoid boiler damage.

Connected into the fuel supply line 65 below the shut-off valve 66 is a line 72 carrying fuel to a gravity feed tank 74 (FIG. 1), which is located above the boiler 42. Tank 74 has a float-controlled valve (not shown) that regulates the inflow of fuel to maintain the fuel level more or less constant.

Gravity tank 74 has an outlet pipe 76 in the bottom that opens into the top side of a horizontal transfer pump housing 78, having a cylindrical bore within which a spool-shaped pump body 80 slides. Pump body 80 has an annular pocket 82 at its midpoint lying between two cylindrical end sections which fit closely within the cylindrical bore. Each of the end sections has ring seals 84, that seal the pump body against gas leakage. Pump body 80 is slidable lengthwise in its cylindrical bore between the right-hand position shown in FIG. 1, and a left-hand position in which the annular pocket 82 registers with an outlet duct 86, which opens directly into the interior of the boiler shell 44. A second duct 88 at the extreme left-hand end of the pump housing 78 also opens into the boiler, and its purpose is to vent the left-hand end of the cylindrical bore so that when the end section of the pump body 80 covers the outlet duct 86, there will not be air or gas trapped in the end of the cylinder which is compressed as the pump body continues its travel toward the left. In other words, duct 88 allows boiler vapor to flow into or out of the left-hand end of the bore as the pump body moves to the right or left while the left-hand end section of the pump body covers the outlet duct 86. Another vent pipe 89 is provided in the top of the pump housing 78 midway between the outlet duct 86 and fuel outlet pipe 76, and its purpose is to vent the highly compressed gas that has filled the annular pocket 82 when the liquid fuel was dumped into the boiler. If this compressed gas were not vented, it would blow back through the liquid fuel in the tank 74, which would be undesirable. Instead, the vent pipe 89 leaks to the combustion chamber 56 (FIG. 4) where the vented-off gas is burned off and its heat added to that of the flame coming from the burner 58.

The annular pocket 82 is relatively small, and holds only a fraction of a fluid once of liquid fuel, so that with each complete back-and-forth movement of the pump body, a small quantity of liquid fuel is transferred from the gravity tank 74 to the outlet duct 86, where it is dumped into the boiler 42 and falls onto the hot fire tubes 50. As the liquid fuel cascades onto the hot fire tubes, it flashes into vapor and then heats up almost instantaneously to a temperature of several hundred degrees Fahrenheit, becoming highly superheated in the process. Pressure within the boiler may range upwardly from 250 psi, depending upon the compression ratio of the engine and the type of fuel being used. The boiler 42 is relatively small in size, as the amount of fuel to be vaporized and superheated is quite small. For example, at 70 mph, the average automobile consumes about 6 gallons of gasoline per hour, and at that rate, the boiler is called upon to vaporize 1 gallon of gasoline in 10 minutes.

The pump body 80 is moved back and forth within its bore by an operating lever 90 which is pivotally supported by a shaft 92. The upper end of lever 90 is bifurcated and bears against a compression spring 93 which surrounds a rod 94 projecting axially from the right-hand end of the pump body 80 through the open right-hand end of housing 78. A nut 95 is screwed onto the threaded outer end of rod 94 and engages the back side of lever 90. Thus, clockwise oscillation of the lever 90 causes the top end of the lever to press against nut 95 and pull the pump body 80 to the right. Spring 93 serves as a safety feature to keep the boiler 42 from being supplied with an amount of fuel in excess of the amount being injected into the cylinder, as when the engine is idling or running under light load. In that case, the excess amount of liquid fuel dumped into the boiler by transfer pump body 80 causes the boiler pressure to rise, and this high pressure, acting against the lefthand end surface area of the pump body, increases the resistance of the body to movement toward the left, to such an extent that the spring 93 is unable to push the pump body ahead of it, and instead compresses. This continues until the excess pressure has been bled off into the cylinder's combustion chamber, at which point the spring is again enable to push the pump body over and thereby transfer fuel to the boiler. An adjusting nut 97 on shaft 94 ahead of spring 93 can be backed off to compress the spring to any desired preload. The bottom end of the lever 90 has a cam follower roller 96 which rides on a rotating cam 100, the latter being driven from the crankshaft or camshaft of the engine by any suitable driving connection (not shown).

The superheated, highpressure fuel vapor in the boiler 42 is injected into combustion chamber 18 at the peak of the compression stage by means of a rotary valve 102 disposed within a valve housing 104 (see FIG. 2) formed integrally with the cylinder 12 or its head. Housing 104 has a cylindrical bore 106, in which the cylindrical valve member 102 is slidably and rotatably supported. Narrow, slot-like orifices 108 and 109 are formed in the housing 104 on opposite sides of the valve member 102. Orifice 108 opens from one side of the bore 106 into the combustion chamber 18, while orifice 109 opens from the other side of the bore into the boiler 42. Valve member 102 has a passageway provided therein which registers with both of the orifices 108, 109 when the member is turned to one particular position, as shown in FIGS. 1 and 2.

The passageway in the valve member may take any of several different forms, for example, in FIGS. 5 and 6, the valve member is designated 102', and the passageway consists of a square notch 110 cut into one side thereof. The width of notch 110 is approximately the same as the width of orifices 108, 109, and the depth of the notch is slightly less than half the diameter of the valve member. Thus, the bottom of the notch 110 is slightly above the horizontal diameter of the valve member, and both of the orifices 108, 109 are slightly above the horizontal diameter, so that the notch 110 registers with orifices 108, 109 only when the valve is in the position shown in FIG. 6. When the valve member 102' is turned 180°, both orifices 108, 109 are closed by the solid part of the member. This form of valve member turns (for a four-cycle engine) at half crankshaft speed, and makes one complete revolution when the crankshaft has made two revolutions.

Another form of valve member 102 is shown in FIGS. 7 and 8. In this case, the passageway in the valve member consists of a narrow rectangular slot 112 of the same width and height as the orifices 108, 109. In FIG. 8, the orifices 108, 109 are directly across from one another on the horizontal diameter of the valve member 102, and slot 112 is also on the diameter. Since slot 112 registers with the orifices 108, 109 when the member 102 is in the position shown, or when turned 180 degrees from this position, the valve member 102 is driven (in a four-cycle engine) at one-fourth crankshaft speed, and thus revolves 180 degrees for each two revolutions of the crankshaft.

Valve member 102 slides axially in the bore 106 to control the effective orifice size and thereby vary the amount of fuel injected into the combustion chamber, in order to control the engine speed and to achieve idling — the throttle valve 35 being simultaneously adjusted to provide the desired fuel/air ratio. To this end a shifting lever 114 (see FIG. 2) is provided, said lever being pivoted intermediate its ends on a pivot shaft 116 and having shaft fingers 118 at one end which ride in a circumferential groove 120 in the valve member 102. When lever 114 is rocked on pivot 116, member 102 is shifted one way or the other in bore 106. In FIG. 2, passageway 112 is fully aligned with orifices 108, 109 and the valve is open to its fullest extent. If the valve member 102 is raised (in FIG. 2), the orifices 108, 109 are partially blocked by the solid bottom end of the member, and this restriction reduces the amount of gas that can flow from the boiler into the combustion chamber.

Valve member 102 is driven by a gear 122 that meshes with another gear (not shown) which may be driven in any suitable manner from the crankshaft. Driving connection between gear 122 and valve member 102 is by means of lengthwise extending splines 124 which mesh with companionate internal splines in the hub of the gear. Gear 122 is constrained against endwise movement by means (not shown), and the valve member 102 rotates as one with the gear member and slides axially through the hub thereof when the shift lever 114 is rocked. Sealing rings 126 seal the valve member against gas leakage.

When the engine is running under the fuel injection mode, the timing of the valve member 102 is as shown in FIGS. 3A, 3B, 3C and 3D. In 3A, the rotary valve 102 is opened, and highly superheated fuel vapor under high pressure is being injected into the combustion chamber at the peak of the compression cycle. As the hot fuel vapor, heated to a temperature above its flash point, mixes with the oxygen in the compressed air, it ignites, and the power stroke is initiated. FIG. 3A shows the start of the power stroke. In FIG. 3B, the piston 14 has reached the bottom of its stroke, rotary valve 102 has turned counterclockwise 45° and is closed, and exhaust valve 26 is opened. FIG. 3B shows the start of the exhaust stroke.

In FIG. 3C, the piston 14 has reached the top of its travel, rotary valve 102 has now turned 90 degrees from its starting position, and the intake valve 22 is opened. FIG. 3C shows the start of the air intake stroke. In FIG. 3D, the piston has reached the bottom of its travel, rotary valve 102 has now turned 135° from its starting position, and both intake and exhaust valves 22, 26 are closed. FIG. 3D shows the start of the compression stroke.

When the engine is first started, and before the boiler 42 has reached operating temperature and pressure, it is operated as a conventional gasoline engine, using liquid gasoline atomized into the intake air by carburetor 30. If the compression ratio of the engine is too high for the octane rating of the gasoline, the spark may be retarded to prevent detonation. As soon as the boiler 42 comes up to operating temperature and pressure, the fuel supply to the carburetor is cut off by energizing solenoid 40, which closes the cut-off valve 38, and the engine thereafter runs on injected fuel vapor. If engine 10 were a diesel engine, the solenoid actuated cut-off valve 38 would shut off the flow of fuel to the injectors.

The pressure in boiler 42 must be not only high enough to overcome the compression pressure in combustion chamber 18, but also high enough to overcome the substantial pressure rise due to combustion as the first portion of the fuel vapor injected into the cylinder mixes with air and begins to burn. Thus, the pressure in boiler 42 may be from 250 psi up to whatever pressure is required for that particular engine.

The velocity of a gas passing through an orifice rises steeply as the pressure differential rises, until a pressure differential of about 30 psi is reached, at which point the velocity approaches (Mach 1 (i.e., 1087 ft. per sec.). From this point on, the pressure curve flattens out, and above about 2000 psi the curve is almost flat, at about 1300 ft. per sec. Thus, in the pressure range of boiler 42, the velocity of the superheated fuel vapor passing through the rotary valve 102 and orifices 108,

109 is about 1300 ft. per sec. The velocity of the gas is reduced somewhat by an orifice factor, but with good design, the velocity can be maintained close to Mach 1. Because of this extremely high velocity of the gas, it is possible to inject the required amount of fuel vapor into the combustion chamber at speeds up to 6000 rpm a and beyond.

The flash point of gasoline is only about 125° F, whereas the temperature of the superheated fuel vapor in the boiler 42 may be in the range of 400° to 600° F, or more, depending upon the pressure. The only reason that the gasoline can be heated to these temperatures in the boiler without igniting is that the boiler is completely devoid of oxygen. Hence, the instant that the superheated fuel vapor mixes with oxygen in the combustion chamber 18, it ignites. Ignition occurs as the fuel vapor issues from the orifice 108 and mixes with the air, which takes place progressively over a period of from one to several milliseconds. This progressive addition of injected fuel vapor during the power stroke eliminates the detonation and gives the present engine torque characteristics similar to those of a diesel engine. Fuel-air ratios are not critical because any hot, gaseous fuel allowed to mix with the oxygen-bearing atmosphere in the combustion chamber will burn completely, provided there is enough oxygen, and the power output of the engine will be directly proportional to the amount of fuel vapor injected.

The present invention is clearly distinguished from prior gasoline or Diesel engines in one important respect: The heat of vaporization is added to the fuel before the fuel reaches the combustion chamber, and therefore this heat of vaporization is added to the combustion heat of the engine, instead of being subtracted from it, and therefore adds to the power output. The present invention thus combines the principles of both internal and external combustion engines. The injection of high pressure fuel vapor also has the effect of increasing the compression ratio.

Another important aspect of the invention is that the jet stream of rich fuel vapor issuing from the orifice 108 is aimed directly at the spark plug 28 on the opposite side of the combustion chamber, and if the fuel being used has an extremely high flash point, approaching the coking temperature of the fuel, it may be desirable to reduce the temperature of the fuel vapor to a temperature below the flash point, and ignition of the fuel/air mixture can then be initiated by the spark plug 28. In this case, the heat of vaporization of the fuel is added to the combustion heat, and thus to the power output of the engine, but the fuel/air mixture is ignited by a spark, instead of flashing into flame by self-ignition. Another alternative would be to mix a certain proportion of low flash point fuel (e.g., gasoline) with a high flash point fuel to provide a mixed fuel, part of which will self-ignite, and the remainder will be ignited by the flash of the first part While I have shown and described in considerable detail what I believe to be the preferred embodiment of the invention, it will be understood by those skilled in the art that the invention is not limited to such details, but might take various other forms with the scope of the claims.

What I claim is:

1. An internal combustion engine comprising, in combination:

a stationary housing having a movable power transmitting member cooperating therewith to define a variable displacement combustion chamber;

means for admitting fresh air into said combustion chamber, said fresh air being subsequently compressed within the combustion chamber by said movable power transmitting member;

means, comprising a boiler, external to said combustion chamber for adding the latent heat of vaporization and a component of superheat to liquid fuel, so as to convert the same into a superheated gaseous state under high pressure exceeding the pressure of said compressed air;

said boiler being connected to the exhaust of said engine so that the heat in the exhaust gas is utilized in vaporizing said liquid fuel;

said boiler also having a burner for generating additional heat when needed;

means for delivering liquid fuel to said boiler at approximately the same rate as the fuel is used by the engine;

valve means operable to discharge a metered amount of superheated fuel vapor into said combustion chamber near the peak of the compression stage, said valve means comprising a spool-type transfer pump for supplying liquid fuel to said boiler at approximately the same rate that it is consumed by the engine;

a passageway directly connecting said boiler to said combustion chamber; and a valve rotatable and slidable longitudinally within said passageway to vary the orifice size when the valve is open, thereby regulating the amount of fuel vapor that is injected into the combustion chamber.

* * * * *